US008642913B2

(12) United States Patent
Maloney

(10) Patent No.: US 8,642,913 B2
(45) Date of Patent: Feb. 4, 2014

(54) ELECTRICAL SWITCHING APPARATUS, AND ARC CHUTE AND VENTING ASSEMBLY THEREFOR

(75) Inventor: James Gerard Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 476 days.

(21) Appl. No.: 13/114,629

(22) Filed: May 24, 2011

(65) Prior Publication Data

US 2012/0298627 A1 Nov. 29, 2012

(51) Int. Cl.
*H01H 9/30* (2006.01)
*H01H 33/02* (2006.01)

(52) U.S. Cl.
USPC ..... 218/157; 218/149; 218/35; 335/201

(58) Field of Classification Search
USPC ..... 218/15, 34–38, 147–151, 156, 157; 335/201
See application file for complete search history.

(56) References Cited

U.S. PATENT DOCUMENTS 4,963,849 A * 10/1990 Kowalczyk et al. ..... 335/201
6,248,970 B1 * 6/2001 DiMarco et al. ..... 218/149
6,297,465 B1 10/2001 Groves et al.
6,700,087 B2 * 3/2004 Rademacher et al. ..... 218/149
6,703,576 B1 3/2004 Chou et al.
7,034,242 B1 4/2006 Shea et al.
7,598,833 B1 10/2009 Hodges et al.
7,674,996 B2 3/2010 Shea et al.
7,812,276 B2 10/2010 Maloney et al.
2008/0067153 A1 * 3/2008 Pollitt et al. ..... 218/154
2012/0043302 A1 * 2/2012 Schaltenbrand et al. ..... 218/149

* cited by examiner

*Primary Examiner* — Amy Cohen Johnson
*Assistant Examiner* — Marina Fishman
(74) *Attorney, Agent, or Firm* — Eckert, Seamans Cherin & Mellott, LLC; Grant E. Coffield

(57) ABSTRACT

A venting assembly is provided for an arc chute of an electrical switching apparatus, such as a circuit breaker. The circuit breaker includes a housing and separable contacts. An arc and ionized gases are generated in response to the separable contacts tripping open. The arc chute includes a plurality of arc splitters each having first and second opposing sides, an interior passage, and an exterior. The venting assembly includes a first portion coupled to the first side of at least one of the arc splitters and including a venting segment with first venting apertures. A second portion is coupled to the second side and includes a second venting segment having second venting apertures. The first and second venting segments are spaced from the exterior of the arc splitters to form first and second cooling chambers for cooling the ionized gases. The first and second venting apertures vent the ionized gases.

20 Claims, 3 Drawing Sheets

ELECTRICAL SWITCHING APPARATUS, AND ARC CHUTE AND VENTING ASSEMBLY THEREFOR

BACKGROUND

1. Field

The disclosed concept relates generally to electrical switching apparatus and, more particularly, to electrical switching apparatus, such as circuit breakers. The disclosed concept also relates to arc chutes for electrical switching apparatus. The disclosed concept further relates to venting assemblies for arc chutes.

2. Background Information

Electrical switching apparatus, such as circuit breakers, provide protection for electrical systems from electrical fault conditions such as, for example, current overloads, short circuits, and abnormal level voltage conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Therefore, it is desirable to extinguish any such arcs as soon as possible upon their propagation.

To facilitate this process, circuit breakers typically include arc chute assemblies which are structured to attract and break-up the arcs. Specifically, the movable contacts of the circuit breaker are mounted on arms that are contained in a pivoting assembly which pivots the movable contacts past or through arc chutes as they move into and out of electrical contact with the stationary contacts. Each arc chute includes a plurality of spaced apart are splitters or arc plates mounted in a wrapper. As the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates. Examples of arc chutes are disclosed in U.S. Pat. Nos. 7,034,242; 6,703,576; and 6,297,465.

Additionally, along with the generation of the arc itself, ionized gases are formed as a byproduct of the arcing event. Such gases can cause excessive heat, additional arcing, and internal pressure and, therefore, are harmful to electrical components. The ionized gases can undesirably cause the arc to bypass a number of intermediate arc plates as it moves through the arc chute. This reduces the number of arc voltage drops and the effectiveness of the arc chute. It also creates current and gas flow patterns that tend to collapse groups of arc plates together, further reducing the voltage divisions in the arc chute and its cooling effectiveness. Additionally, the internal pressure generated by this volume of gas can cause damage to the circuit breaker.

There is a need, therefore, room for improvement in electrical switching apparatus, such as circuit breakers, and in arc chutes and venting assemblies therefor.

SUMMARY

These needs and others are met by embodiments of the disclosed concept, which are directed to venting assemblies for arc chutes of electrical switching apparatus, such as circuit breakers. Among other benefits, the venting assembly cools and vents ionized gases and associated pressure generated by an arcing event.

As one aspect of the disclosed concept, a venting assembly is provided for an arc chute of an electrical switching apparatus. The electrical switching apparatus includes a housing and separable contacts enclosed by the housing. The separable contacts are structured to trip open. An arc and ionized gases are generated in response to the separable contacts tripping open. The arc chute comprises a plurality of arc splitters each including a first side, a second side disposed opposite and distal from the first side, an interior passage between the first side and the second side, and an exterior. The venting assembly comprises: a first portion including a first venting segment having a number of first venting apertures, the first portion being structured to be coupled to the first side of at least one of the arc splitters, the first venting segment being structured to be spaced from the exterior of the at least one of the arc splitters to form a first cooling chamber; and a second portion including a second venting segment having a number of second venting apertures, the second portion being structured to be coupled to the second side of at least one of the arc splitters, the second venting segment being structured to be spaced from the exterior of the at least one of the arc splitters to form a second cooling chamber.

The first portion may be a first member, and the second portion may be a second member, wherein each of the first member and the second member has a first end and a second end disposed opposite and distal from the first end. The first cooling chamber may be disposed between the first end of the first member and the second end of the first member, and the second cooling chamber may be disposed between the first end of the second member and the second end of the second member. The first member and the second member may be substantially identical.

The arc splitters may be a plurality of U-shaped members each including a base, a first leg extending outwardly from the base, and a second leg extending outwardly from the base opposite and spaced apart from the first leg. The first end of the first member may include a plurality of molded recesses each being structured to receive a portion of the first leg of a corresponding one of the U-shaped members, and the second end of the first member may include a plurality of arcuate portions each being structured to receive a portion of the base on the first side of the corresponding one of the U-shaped members. The first end of the second member may include a plurality of molded recesses each being structured to receive a portion of the second leg of a corresponding one of the U-shaped members, and the second end of the second member may include a plurality of arcuate portions each being structured to receive a portion of the base on the second side of the corresponding one of the U-shaped members.

An arc chute and an electrical switching apparatus employing the aforementioned venting assembly, are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
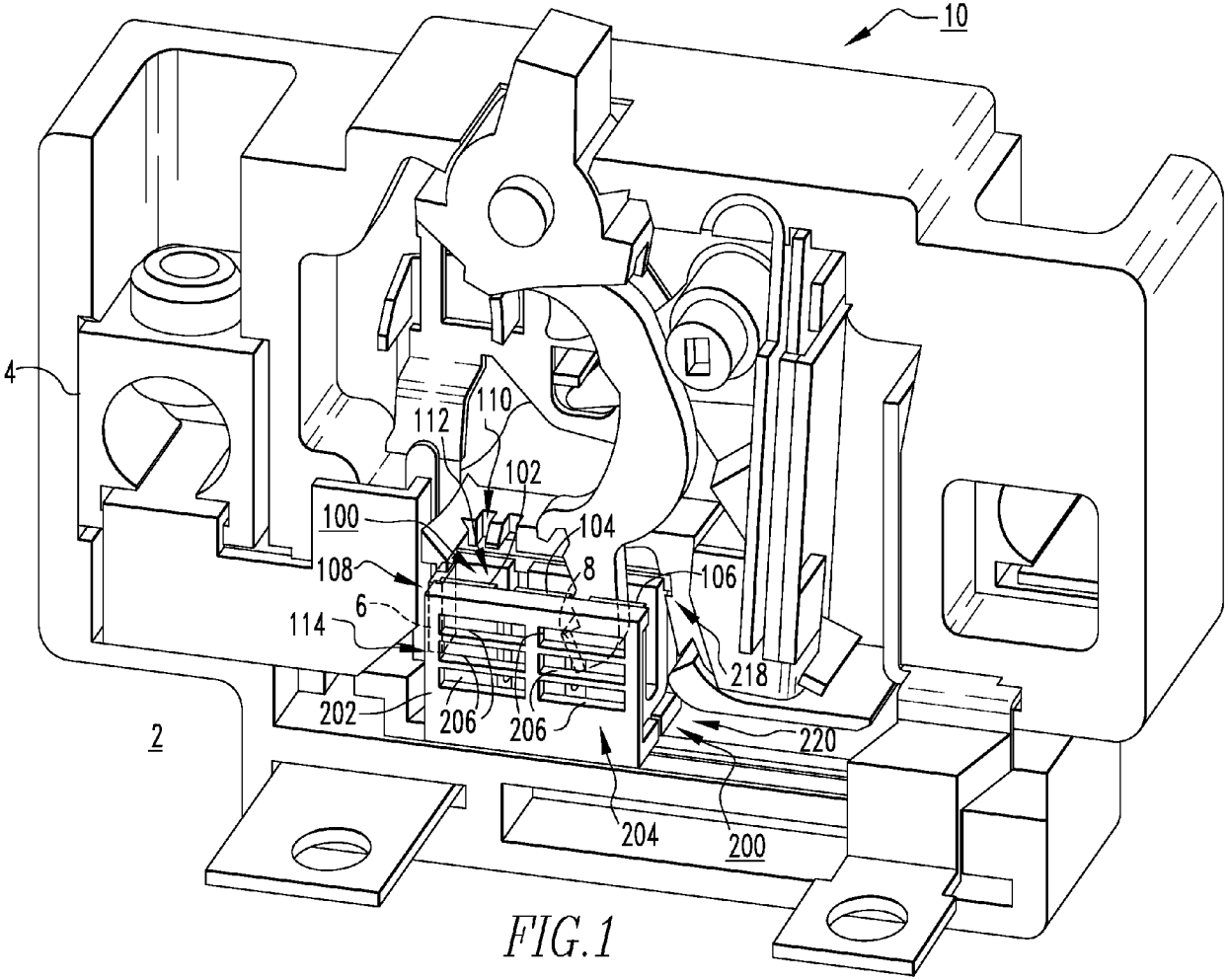
FIG. 1 is an isometric section view of a circuit breaker, and an arc chute and venting assembly therefor, in accordance with an embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a venting assembly 200 for the arc chute 100 of an electrical switching apparatus such as, for example and without limitation, a molded case circuit breaker 2 (shown in section view in FIG. 1). The circuit breaker 2 includes a housing 4 and separable contacts 6, 8 enclosed by the housing 4. An operating mechanism (generally indicated by reference 10 in FIG. 1) is structured to open and close the separable contacts 6, 8 and to trip open the separable contacts 6, 8 in response to an electrical fault. In the example of FIG. 1, one of the separable contacts 6, 8 is a stationary or fixed contact 6 and the other contact 8 is a movable contact 8, which is structured to move into and out of electrical contact with the stationary contact 6 and through the arc chute 100.

More specifically, the arc chute assembly 100 is disposed at or about the separable contacts 6, 8, in order to attract and dissipate an arc 12 (shown in exaggerated form in FIGS. 2 and 4) and ionized gasses 14, 16 (shown in simplified form in phantom line drawing in FIGS. 2 and 4), which are generated by the separable contacts 6, 8 tripping open in response to the electrical fault. It will be appreciated that, while the circuit breaker 2 shown and described herein is a single pole circuit breaker 2 having a single pair of separable contacts 6, 8 and a single corresponding arc chute 100 and venting assembly 200 therefor, that any known or suitable alternative number and/or configuration of poles, arc chutes and venting assemblies (not shown) could be employed, without departing from the scope of the disclosed concept.

The arc chute 100 includes a plurality of arc splitters 102, 104, 106 (e.g., without limitation, arc plates) (three are shown in the non-limiting example embodiment shown and described herein). For economy of disclosure and ease of illustration, only one of the arc splitters 102 will be shown and described herein in detail. Specifically, as shown in FIGS. 2-4, arc splitter 102 includes first and second opposing sides 108, 110, an interior passage 112 between the first and second sides 108,110, through which the aforementioned movable contact 8 (FIG. 1) moves, and an exterior 114.

Figure 2:
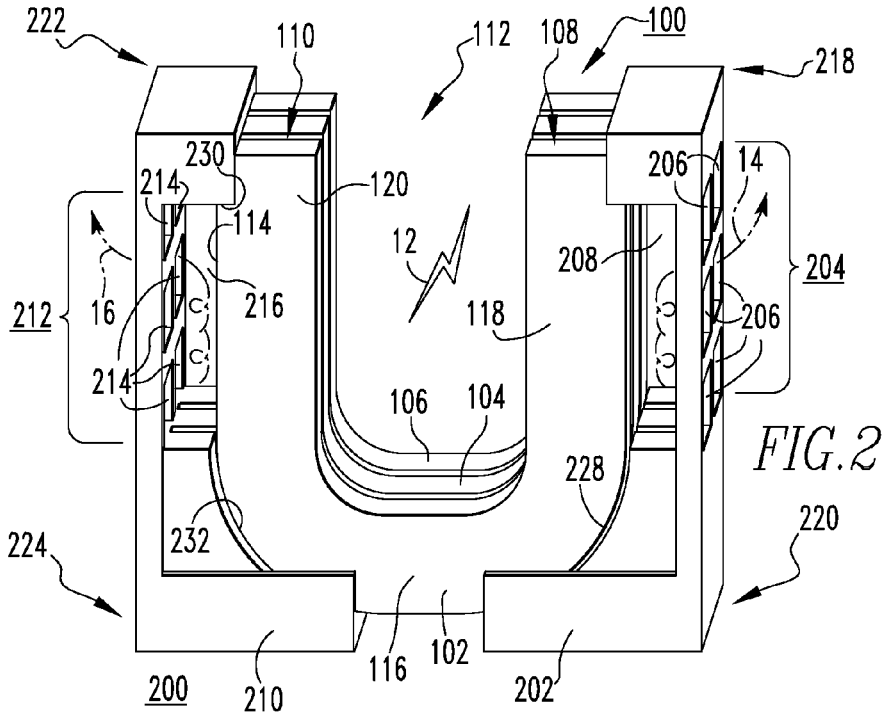
FIG. 2 is an end isometric view of the arc chute and venting assembly therefor of FIG. 1.
Figure 3:
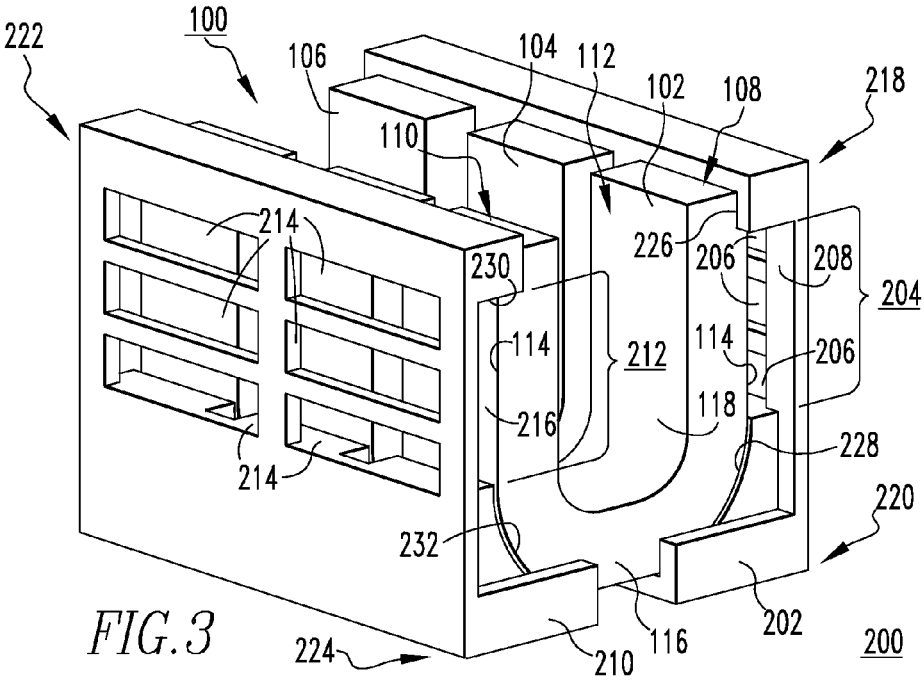
FIG. 3 is a side isometric view of the arc chute and venting assembly therefor of FIG. 2.
Figure 4:
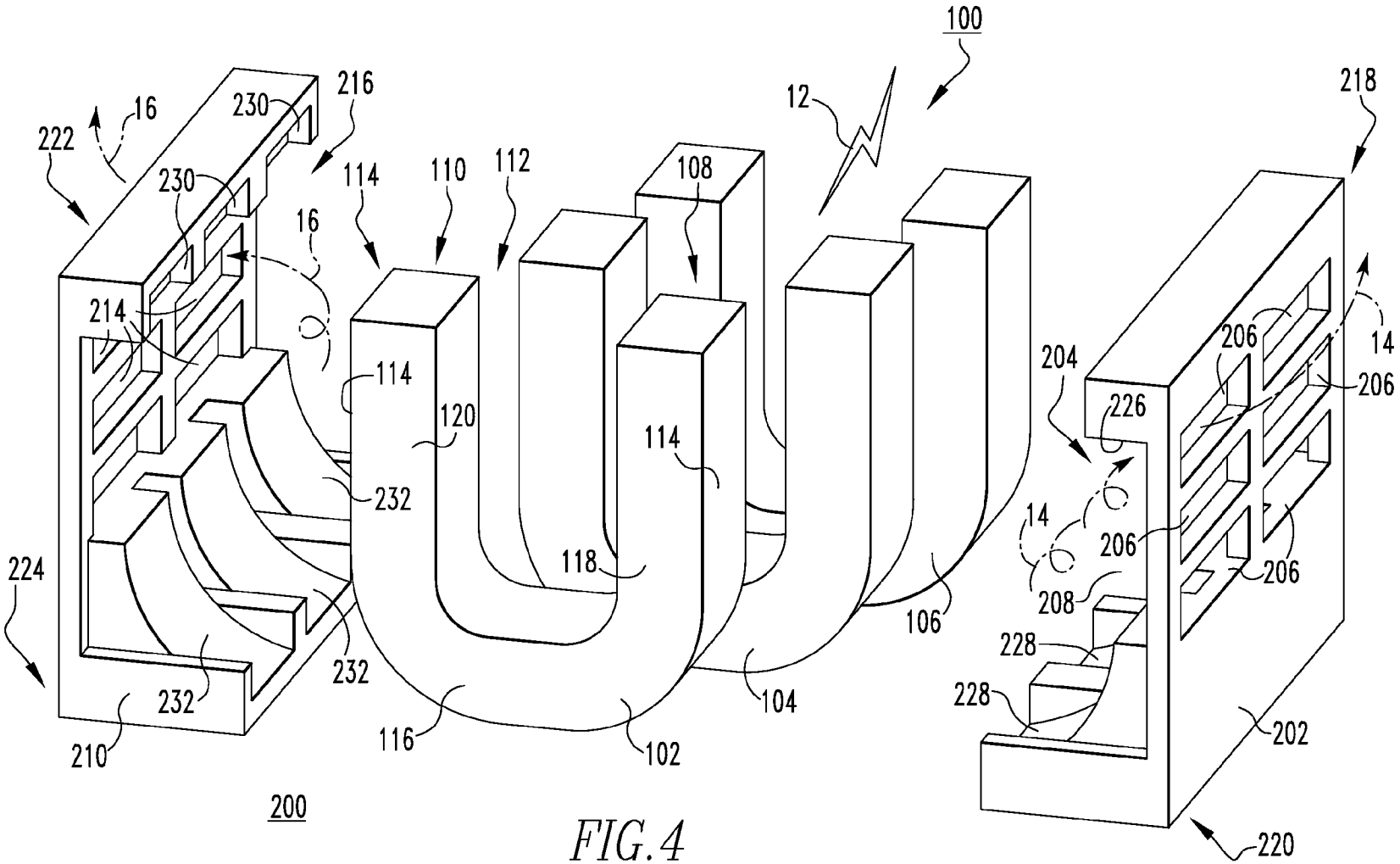
FIG. 4 is an exploded isometric view of the arc chute and venting assembly therefor of FIG. 3.

Continuing to refer to FIGS. 2-4, the venting assembly 200 includes a first portion 202 having a first venting segment 204 with a number of first venting apertures. The first portion, which in the example shown and described herein is a first member 202, is coupled to the first side 108 of at least one of the arc splitters 102, 104, 106. The first venting segment 204 is spaced from the exterior 114 of the arc splitters 102, 104, 106 to form a first cooling chamber 208 (best shown in the end isometric view of FIG. 2). Similarly, the second portion 210 includes a second venting segment 212 having a number of venting apertures 214. The second portion, which in the example shown and described herein is a separate second member 210, is coupled to the second side 110 of at least one of the arc splitters 102, 104, 106. The second venting segment 212 is spaced from the exterior 114 of the arc splitters 102, 104, 106 to form a second cooling chamber 216 (best shown in FIG. 2). Preferably, the first and second members 202,210 are substantially identical, and are suitably coupled to the arc chute 100, without requiring a number of separate fasteners. It will be appreciated that, among other benefits, this simplifies assembly and maintenance, and reduces manufacturing costs. It will, however, be appreciated that any known or suitable alternative number and/or configuration of members (e.g., without limitation, members 202, 210) could be employed, without departing from the scope of the disclosed concept. For example and without limitation, rather than two separate members 202, 210, as shown and described herein, it is foreseeable that one single-piece member (not shown) could be employed.

The first member 202 of the example venting assembly 200 includes first and second opposing ends 218, 220, and the second member 210 includes first and second opposing ends 222, 224. The first cooling chamber 208 is disposed between the first and second ends 218, 220 of the first member, and the second cooling chamber 216 is disposed between the first and second ends 222, 224 of the second member 210.

As best shown in FIG. 4, the example arc splitters are U-shaped members 102, 104, 106, each including a base 116, and first and second legs 118, 120 extending outwardly from the base opposite and spaced apart from one another. The first end 218 of the first member 202 includes a plurality of molded recesses 226 each being structured to receive a portion (e.g., without limitation, end portion) of the first leg 118 of a corresponding one of the U-shaped members 102. The second end 220 of the first member 202 includes a plurality of arcuate portions 228 each being structured to receive a portion of the base 116 on the first side 108 of the corresponding one of the U-shaped members 102. Similarly, the first end 222 of the second member 210 includes molded recesses 230 each receiving a portion (e.g., without limitation, end portion) of the second leg 120 of a corresponding one of the U-shaped members 102, and the second end 224 of the second member 210 includes a plurality of arcuate portions 232. Each arcuate portion 232 receives a portion of the base 116 on the second side 110 of the corresponding U-shaped member 102, as shown in FIGS. 2 and 3.

It will be appreciated that, while the example venting assembly 200 includes two molded members 202, 210 each having three molded recesses 226, 230 and three arcuate portions 228, 232, respectively, for receiving three corresponding arc splitters 102, 104, 106, that each member (e.g., without limitation, members 202,210) could have any known or suitable alternative configuration for accommodating any known or suitable arc chute 100 and, in particular, the arc splitters (e.g., without limitation, arc splitters 102, 104, 106) thereof. It will further be appreciated that the molded nature of the members 202, 210 secures and electrically insulates the arc splitters 102, 104, 106 from one another.

Continuing to refer to FIG. 4, and also to FIG. 2, it will be appreciated that the venting assembly 200 preferably includes a plurality of first and second venting apertures 206, 214 extending through the first and second members 202, 210, respectively. Specifically, in the example shown and described herein, six elongated openings 206 extend through the first member 202 between the first and second ends 218, 220 thereof, in order to vent ionized gasses 14 (shown in simplified form in phantom line drawing in FIGS. 2 and 4) from the first cooling chamber 208. Similarly, six elongated openings 214 extend through the second member 210 between the first and second ends 222, 224 thereof, in order to vent the ionized gasses 16 (shown in simplified form in phantom line drawing in FIGS. 2 and 4) from the second cooling chamber 216. However, any known or suitable alternative number and/or configuration of venting apertures (not shown) could be employed with the scope of the disclosed concept.

Accordingly, the disclosed venting assembly 200 provides cooling chambers 208, 216 on the exterior 114 of the arc splitters 102, 104, 106, as well as air vents 206, 214. Among other benefits, the cooling chambers 208, 216 create a vortex of relatively cooler air (see, for example, vortex of gasses 14, 16, shown in simplified form in phantom line drawing in FIGS. 2 and 4) compared to the super-heated ionized gas that is known to be present on the inside of the arc chute 100. This is a substantial improvement over known arc chute assemblies (not shown), which are generally devoid of such cooling chambers and, therefore, hold such ionized gases and associated heat captive within the molded material of the circuit breaker 2 (FIG. 1). The cooling ability of the disclosed venting assembly 200 is further enhanced by the inclusion of the aforementioned air vents 206, 214, which also function to reduce internal pressure during interruption.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A venting assembly for an arc chute of an electrical switching apparatus, said electrical switching apparatus including a housing and separable contacts enclosed by said housing, said separable contacts being structured to trip open, an arc and ionized gases being generated in response to said separable contacts tripping open, said arc chute comprising a plurality of arc splitters each including a first side, a second side disposed opposite and distal from the first side, an interior passage between the first side and the second side, and an exterior, said venting assembly comprising:

a first portion including a first venting segment having a number of first venting apertures, said first portion being structured to be coupled to the first side of at least one of said arc splitters, said first venting segment being structured to be spaced from the exterior of said at least one of said arc splitters to form a first cooling chamber; and a second portion including a second venting segment having a number of second venting apertures, said second portion being structured to be coupled to the second side of at least one of said arc splitters, said second venting segment being structured to be spaced from the exterior of said at least one of said arc splitters to form a second cooling chamber.

2. The venting assembly of claim 1 wherein said first portion is a first member; wherein said second portion is a second member; wherein each of said first member and said second member has a first end and a second end disposed opposite and distal from the first end; wherein said first cooling chamber is disposed between the first end of said first member and the second end of said first member; and where said second cooling chamber is disposed between the first end of said second member and the second end of said second member.

3. The venting assembly of claim 2 wherein said arc splitters are a plurality of U-shaped members each including a base, a first leg extending outwardly from the base, and a second leg extending outwardly from the base opposite and spaced apart from the first leg; wherein the first end of said first member includes a plurality of molded recesses each being structured to receive a portion of the first leg of a corresponding one of said U-shaped members; wherein the second end of said first member includes a plurality of arcuate portions each being structured to receive a portion of said base on the first side of said corresponding one of said U-shaped members; wherein the first end of said second member includes a plurality of molded recesses each being structured to receive a portion of the second leg of a corresponding one of said U-shaped members; and wherein the second end of said second member includes a plurality of arcuate portions each being structured to receive a portion of said base on the second side of said corresponding one of said U-shaped members.

4. The venting assembly of claim 3 wherein said plurality of U-shaped members is three U-shaped members; wherein said plurality of molded recesses is three molded recesses; and wherein said plurality of arcuate portions is three arcuate portions.

5. The venting assembly of claim 2 wherein said number of first venting apertures is a plurality of first venting apertures extending through said first member between the first end of said first member and the second end of said first member; wherein said plurality of first venting apertures is structured to vent said ionized gases from said first cooling chamber; wherein said number of second venting apertures is a plurality of second venting apertures extending through said second member between the first end of said second member and the second end of said second member; and wherein said plurality of second venting apertures is structured to vent said ionized gases from said second cooling chamber.

6. The venting assembly of claim 5 wherein said plurality of first venting apertures is six elongated openings extending through said first member; and wherein said plurality of second venting apertures is six elongated openings extending through said second member.

7. The venting assembly of claim 2 wherein said first member and said second member are substantially identical.

8. An arc chute for an electrical switching apparatus including a housing and separable contacts enclosed by said housing, said separable contacts being structured to trip open, an arc and ionized gases being generated in response to said separable contacts tripping open, said arc chute comprising:

a plurality of arc splitters each including a first side, a second side disposed opposite and distal from the first side, an interior passage between the first side and the second side, and an exterior; and a venting assembly for cooling and venting said ionized gases, said venting assembly comprising:

a first portion including a first venting segment having a number of first venting apertures, said first portion being coupled to the first side of at least one of said arc splitters, said first venting segment being spaced from the exterior of said at least one of said arc splitters to form a first cooling chamber, and a second portion including a second venting segment having a number of second venting apertures, said second portion being coupled to the second side of at least one of said arc splitters, said second venting segment being spaced from the exterior of said at least one of said arc splitters to form a second cooling chamber.

9. The arc chute of claim 8 wherein said first portion is a first member; wherein said second portion is a second member; wherein each of said first member and said second member has a first end and a second end disposed opposite and distal from the first end; wherein said first cooling chamber is disposed between the first end of said first member and the second end of said first member; and where said second cooling chamber is disposed between the first end of said second member and the second end of said second member.

10. The arc chute of claim 9 wherein said arc splitters are a plurality of U-shaped members each including a base, a first leg extending outwardly from the base, and a second leg extending outwardly from the base opposite and spaced apart from the first leg; wherein the first end of said first member includes a plurality of molded recesses each receiving a portion of the first leg of a corresponding one of said U-shaped members; wherein the second end of said first member includes a plurality of arcuate portions each receiving a portion of said base on the first side of said corresponding one of said U-shaped members; wherein the first end of said second member includes a plurality of molded recesses each receiving a portion of the second leg of a corresponding one of said U-shaped members; and wherein the second end of said second member includes a plurality of arcuate portions each receiving a portion of said base on the second side of said corresponding one of said U-shaped members.

11. The arc chute of claim 10 wherein said plurality of U-shaped members is three U-shaped members; wherein said plurality of molded recesses is three molded recesses; and wherein said plurality of arcuate portions is three arcuate portions.

12. The arc chute of claim 9 wherein said number of first venting apertures is a plurality of first venting apertures extending through said first member between the first end of said first member and the second end of said first member; wherein said plurality of first venting apertures is structured to vent said ionized gases from said first cooling chamber; wherein said number of second venting apertures is a plurality of second venting apertures extending through said second member between the first end of said second member and the second end of said second member; and wherein said plurality of second venting apertures is structured to vent said ionized gases from said second cooling chamber.

13. The arc chute of claim 12 wherein said plurality of first venting apertures is six elongated openings extending through said first member; and wherein said plurality of second venting apertures is six elongated openings extending through said second member.

14. An electrical switching apparatus comprising:

a housing;

separable contacts enclosed by said housing;

an operating mechanism structured to open and close said separable contacts and to trip open said separable contacts in response to an electrical fault; and at least one arc chute assembly disposed at or about said separable contacts in order to attract and dissipate an arc and ionized gases which are generated by said separable contacts tripping open in response to said electrical fault, said at least one arc chute assembly comprising:

a plurality of arc splitters each including a first side, a second side disposed opposite and distal from the first side, an interior passage between the first side and the second side, and an exterior, and a venting assembly for cooling and venting said ionized gases, said venting assembly comprising:

a first portion including a first venting segment having a number of first venting apertures, said first portion being coupled to the first side of at least one of said arc splitters, said first venting segment being spaced from the exterior of said at least one of said arc splitters to form a first cooling chamber, and a second portion including a second venting segment having a number of second venting apertures, said second portion being coupled to the second side of at least one of said arc splitters, said second venting segment being spaced from the exterior of said at least one of said arc splitters to form a second cooling chamber.

15. The electrical switching apparatus of claim 14 wherein said first portion of said venting assembly is a first member; wherein said second portion of said venting assembly is a second member; wherein each of said first member and said second member has a first end and a second end disposed opposite and distal from the first end; wherein said first cooling chamber is disposed between the first end of said first member and the second end of said first member; and where said second cooling chamber is disposed between the first end of said second member and the second end of said second member.

16. The electrical switching apparatus of claim 15 wherein said arc splitters of said at least one arc chute are a plurality of U-shaped members; wherein each of said U-shaped members includes a base, a first leg extending outwardly from the base, and a second leg extending outwardly from the base opposite and spaced apart from the first leg; wherein the first end of said first member includes a plurality of molded recesses each receiving a portion of the first leg of a corresponding one of said U-shaped members; wherein the second end of said first member includes a plurality of arcuate portions each receiving a portion of said base on the first side of said corresponding one of said U-shaped members; wherein the first end of said second member includes a plurality of molded recesses each receiving a portion of the second leg of a corresponding one of said U-shaped members; and wherein the second end of said second member includes a plurality of arcuate portions each receiving a portion of said base on the second side of said corresponding one of said U-shaped members.

17. The electrical switching apparatus of claim 16 wherein said plurality of U-shaped members of said at least one arc chute is three U-shaped members; wherein said plurality of molded recesses is three molded recesses; and wherein said plurality of arcuate portions is three arcuate portions.

18. The electrical switching apparatus of claim 15 wherein said number of first venting apertures of said venting assembly is a plurality of first venting apertures extending through said first member between the first end of said first member and the second end of said first member; wherein said plurality of first venting apertures vents said ionized gases from said first cooling chamber; wherein said number of second venting apertures of said venting assembly is a plurality of second venting apertures extending through said second member between the first end of said second member and the second end of said second member; and wherein said plurality of second venting apertures vents said ionized gases from said second cooling chamber.

19. The electrical switching apparatus of claim 18 wherein said plurality of first venting apertures is six elongated openings extending through said first member; and wherein said plurality of second venting apertures is six elongated openings extending through said second member.

20. The electrical switching apparatus of claim 14 wherein said electrical switching apparatus is a circuit breaker; wherein said separable contacts include a stationary contact and a movable contact; wherein said movable contact moves through the interior passage of said arc splitters of said at least one arc chute; and wherein said venting assembly is disposed on the exterior of said arc splitters to cool said ionized gases is said first cooling chamber and said second cooling chamber and to vent said ionized gases through said first venting apertures and said second venting apertures.

* * * * *